US006164362A

United States Patent [19]

Yang

[11] Patent Number: 6,164,362

[45] Date of Patent: Dec. 26, 2000

[54] TOP-DOWN-BOTTOM-UP SHADE HAVING AN IMPROVED LIFT SYSTEM

[76] Inventor: Nelson T. G. Yang, 9 Swans Mill La., Scotch Plains, N.J. 07076

[21] Appl. No.: 09/391,715

[22] Filed: Sep. 8, 1999

[51] Int. Cl.[7] ..... A47H 5/00

[52] U.S. Cl. ..... 160/84.04; 160/84.03; 160/168.1 R; 160/173 R

[58] Field of Search ..... 160/84.03, 84.04, 160/84.01, 168.1 R, 173 R, 178.1 R, 178.2 R, 115, 116, 201, 236

[56] References Cited

U.S. PATENT DOCUMENTS

| | | | |
|---|---|---|---|
| 337,152 | 3/1886 | Hawley . | |
| 2,247,260 | 6/1941 | Stone | 160/84.04 |
| 2,486,492 | 11/1949 | Redman | 160/173 R |
| 2,652,112 | 9/1953 | Walker | 160/173 R |
| 2,920,695 | 1/1960 | Bennett . | |
| 3,192,991 | 7/1965 | Anderle . | |
| 4,607,677 | 8/1986 | Comeau | 160/84.04 |
| 4,699,196 | 10/1987 | Elliot | 160/168.1 R |
| 4,813,468 | 3/1989 | Fraser | 160/84.03 |
| 4,842,034 | 6/1989 | Haines | 160/84.04 |
| 4,953,610 | 9/1990 | Phillips et al. | 160/84.03 |
| 5,176,192 | 1/1993 | Judkins et al. | 160/84.04 |
| 5,273,097 | 12/1993 | Siegler | 160/84.04 |
| 5,443,108 | 8/1995 | LeVert et al. . | |
| 5,791,390 | 8/1998 | Watanabe . | |

*Primary Examiner*—Bruce A. Lev
*Attorney, Agent, or Firm*—Arthur L. Plevy; Buchanan Ingersoll PC

[57] ABSTRACT

An inexpensive top-down-bottom-up shade made up of a head rail, a top rail, a bottom rail, and an expanse of shade material having a top edge attached to the top rail and a bottom edge attached to the bottom rail. The head rail includes a top rail lift mechanism for lowering and raising the top rail and a bottom rail lift mechanism for raising and lowering the bottom rail. The top rail lift mechanism includes at least two top rail lift cords tied to the top rail and the bottom rail lift mechanism includes at least two bottom rail lift cords that are secured to the bottom rail with washer-shaped elements.

13 Claims, 5 Drawing Sheets

TOP-DOWN-BOTTOM-UP SHADE HAVING AN IMPROVED LIFT SYSTEM

FIELD OF THE INVENTION

This invention relates to window shades made of pleated fabric that stack the fabric when opened, and in particular, to a window shade that opens from the top or the bottom of the shade.

BACKGROUND OF THE INVENTION

Conventional pleated fabric window shades that stack the fabric when opened, typically have a head rail mounted at or above the top of the window from which the fabric depends, and a bottom rail attached along the lower edge of the fabric. The pleated shade is opened and closed by raising and lowering the bottom rail so that, in the open position, the fabric stacks against the head rail at the top of the window.

Pleated fabric window shades can also be constructed with an additional rail (top rail) that is attached along the upper edge of the fabric and suspended from the head rail. The top rail permits the shade to be opened and closed from the top as well as from the bottom, by lowering and raising the top rail so that in the open position, the fabric stacks against the bottom rail at the bottom of the window. This type of shade allows selective covering of the upper part, the lower part, or the entire window, and is commonly referred to as top-down-bottom-up (TDBU) shade because it can be lowered and raised from the top or from the bottom.

Unfortunately, conventional TDBU shades are expensive because they usually employ two complex and costly independent lift systems, one to operate and hold the bottom rail and one to operate and hold the top rail. Although some TDBU shades employ single lift systems, such shades are still relatively expensive because of the complexity and cost of the lift system.

For that and other reasons, there remains a need for an inexpensive TDBU shade.

SUMMARY OF THE INVENTION

A window shade that opens from the top or the bottom thereof. The shade comprises a head rail, a top rail, a bottom rail, and an expanse of shade material having a top edge attached to the top rail and a bottom edge attached to the bottom rail. The head rail includes a top rail lift mechanism for lowering and raising the top rail and a bottom rail lift mechanism for raising and lowering the bottom rail. The top rail lift mechanism includes at least two top rail lift cords tied to the top rail.

BRIEF DESCRIPTION OF THE DRAWINGS

The advantages, nature, and various additional features of the invention will appear more fully upon consideration of the illustrative embodiment now to be described in detail in connection with accompanying drawings wherein.

It should be understood that the drawings are for purposes of illustrating the concepts of the invention and are not to scale.

DETAILED DESCRIPTION OF THE INVENTION

Figure 1:
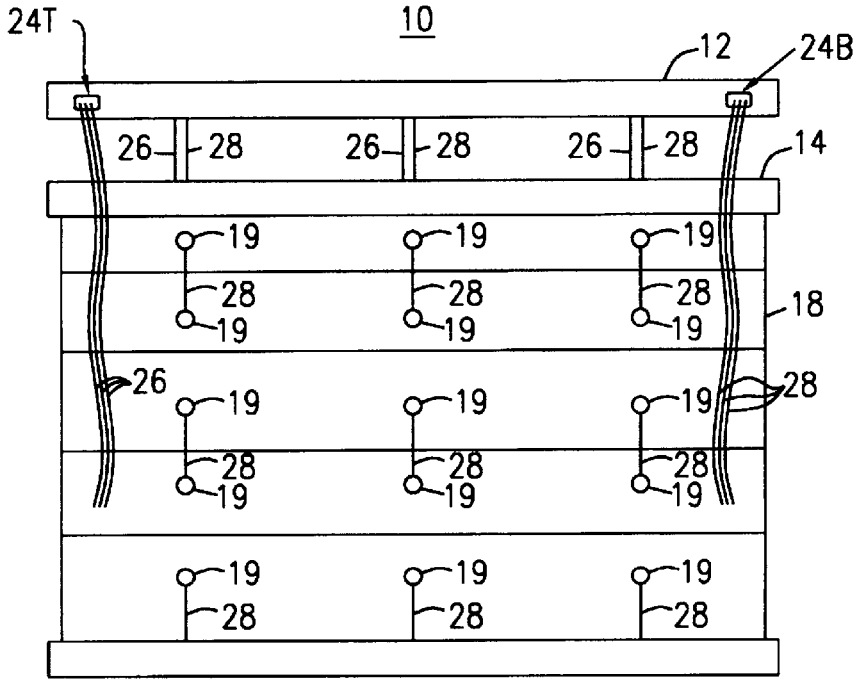
FIG. 1 is an elevational view of a top-down-bottom-up pleated fabric shade 10 according to an exemplary embodiment of the invention.

FIG. 1 shows a top-down-bottom-up pleated fabric shade 10 according to an exemplary embodiment of the invention. The shade 10 comprises a head rail 12, a top rail 14, a bottom rail 16, and an expanse of pleated fabric 18 or other suitable shade material having a top edge 20 attached to the top rail 14 (FIG. 3B) and a bottom edge 22 attached to the bottom rail 16 (FIG. 4B). The head rail 12 contains a top rail lift mechanism 24T for lowering and raising the top rail 14 of the shade 10, and a bottom rail lift mechanism 24B for raising and lowering the bottom rail 16 of the shade 10. The top rail lift mechanism 24T includes at least two (three are shown) top rail lift cords 26 that are routed through the head rail 12 to the top rail 14. The bottom rail lift mechanism 24B includes at least two (three shown) bottom rail lift cords 28 that are routed through the head rail 12, the top rail 14, and holes 19 in the pleated fabric 18 to the bottom rail 16. The exact number of top and bottom lift cords used depends upon the width of the shade 10.

Figure 2:
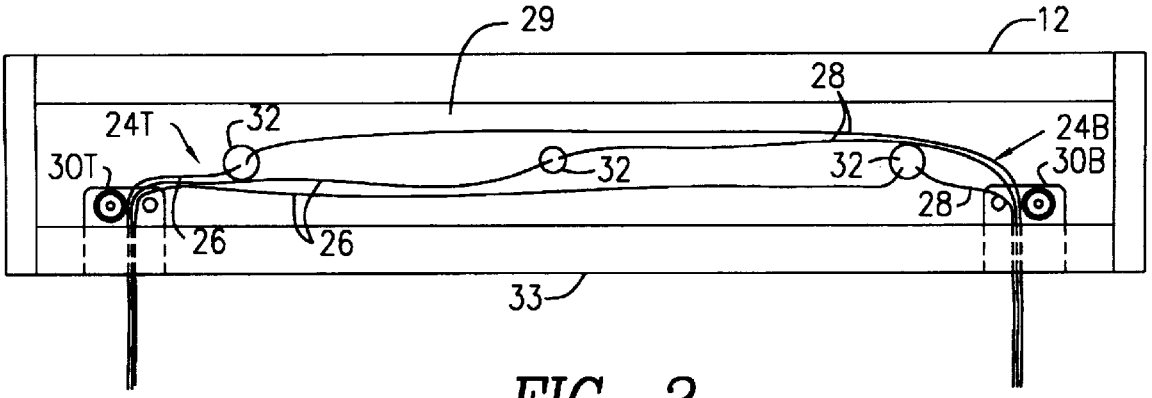
FIG. 2 is a top plan view of a head rail used in the shade of the invention.

FIG. 2 shows a top plan view of the head rail 12. The head rail 12 can be made from plastic, metal or any other suitable material, and includes a recessed channel 29 the bottom of which has cord routing apertures 32 that route the lift cords 26, 28 through the head rail 12 to the top and bottom rails 14, 16. The top rail lift cords 26 are captured with a first conventional cord lock mechanism 30T disposed in the front wall 33 of the head rail 12 adjacent one end thereof, and the bottom rail lift cords 28 are captured with a second conventional cord lock mechanism 30B disposed in the front wall 33 of the head rail 12 adjacent the other end thereof.

Figure 3A:
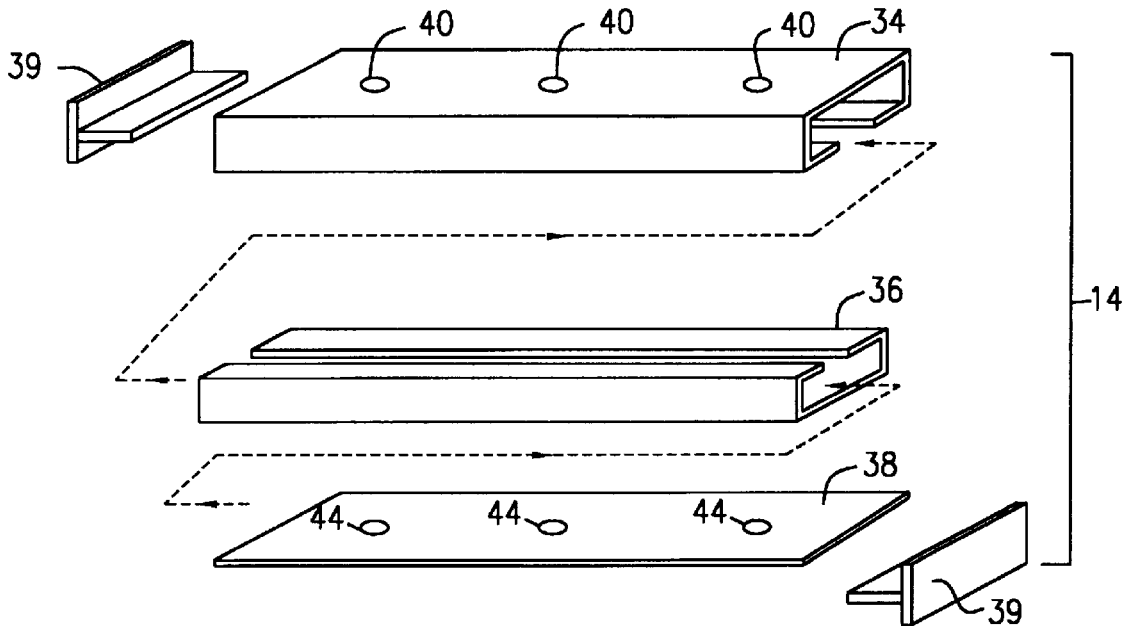
FIG. 3A is an exploded view of a top rail used in the shade of the invention.
Figure 3B:
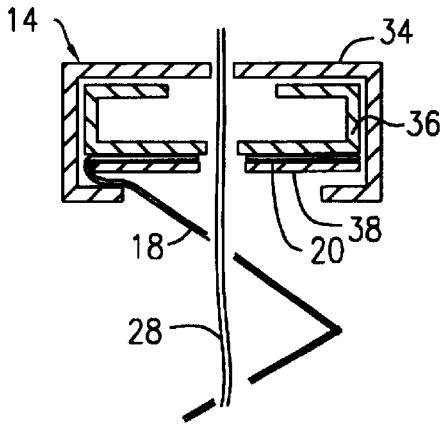
FIG. 3B is a sectional end view of the top rail.

FIG. 3A shows an exploded view of the top rail 14. The top rail 14 can be manufactured from plastic, metal or any other suitable material or combination of materials, and is made up of an elongated C-shaped outer member 34, an elongated C-shaped inner member 36, and an elongated planar substrate member 38. The inner and substrate members 36, 38 are dimensioned to slide into the outer member and be retained therein with plug-shape end caps 39 that frictionally engage the ends of the inner member 36. The substrate member 38 secures the top edge 20 of the shade material 18 to the top rail 14 by wedging it against the inner member 36 as shown in the top rail sectional view of FIG. 3B.

Figure 3C:
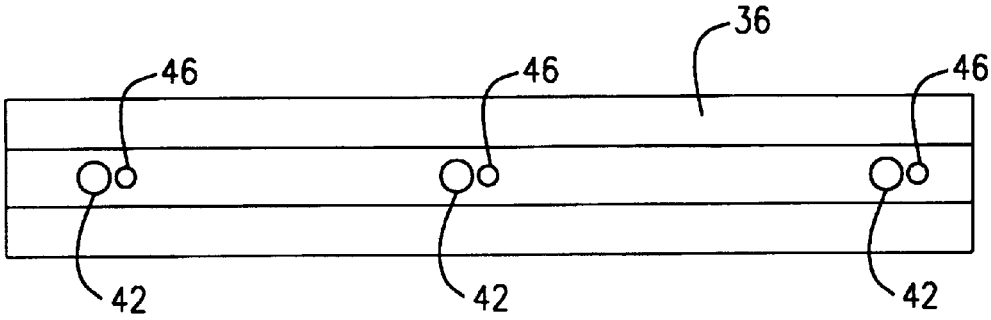
FIG. 3C is a top plan view of the inner member of the top rail.
Figure 3D:
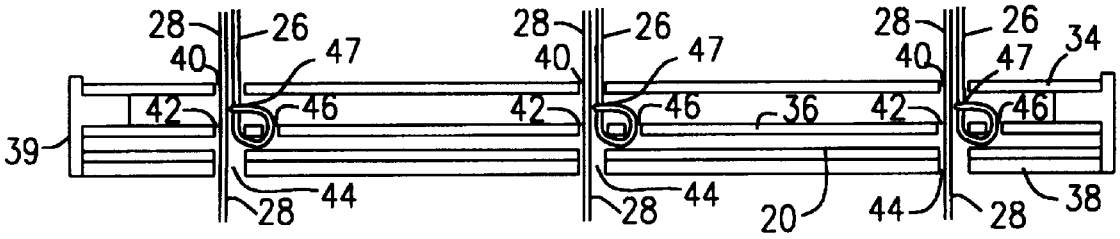
FIG. 3D is a sectional view of the top rail.

Referring to FIGS. 3C and 3D, the inner member 36 of the top rail 14 provides an inexpensive method for routing the bottom rail lift cords 28 through and attaching the top rail lift cords 26 to, the top rail 14. As shown in FIG. 3D, axially aligned cord routing apertures 40, 42, 44 extend through the outer, inner and substrate members 34, 36, 38. As shown in FIG. 3C, adjacent each cord routing aperture 42 in the inner member 36 is a corresponding top rail cord securing aperture 46. The cord routing apertures 40, 42, 44 are positioned in axial alignment with the apertures 32 in the head rail 12 and route the bottom rail lift cords 28 through the top rail 14. The apertures 40 in outer member 34 route the top rail lift cords 26 therethrough. The ends of the top rail lift cords 26 are tied to the inner member 36 by threading the ends of the lift cords 26 down through the inner member cord routing apertures 42, then looping up through the to rail securing apertures 46 and knotting the ends with knots 47.

Figure 4A:
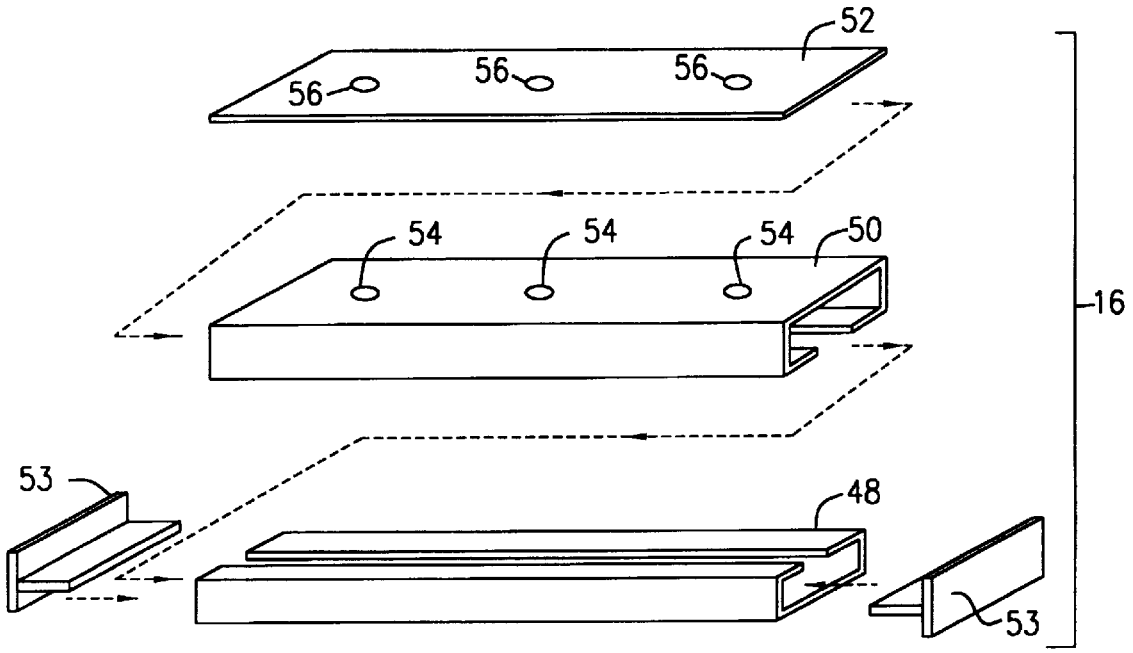
FIG. 4A is an exploded view of a bottom rail used in the shade of the invention.
Figure 4B:
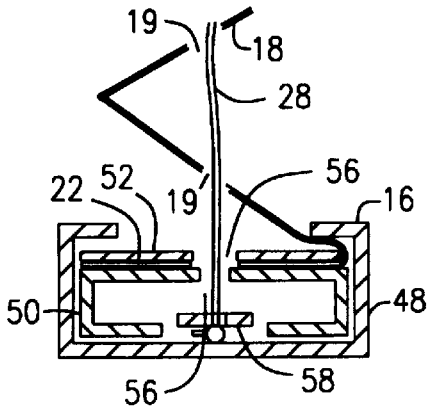
FIG. 4B is a sectional end view of the bottom rail.

FIG. 4A shows a sectional view of the bottom rail 16. To further minimize the cost of the shade 10, the bottom rail 16 is advantageously made up of substantially the same components used for the top rail 14, these components being manufactured from plastic, metal or any other suitable material or combination of materials. Accordingly, the bottom rail 16 includes an elongated C-shaped outer member 48, an elongated C-shaped inner member 50, and an elongated planar substrate member 52. The inner and substrate members 50, 52 are dimensioned to slide into the outer member 48 and be retained therein by plug-shape end caps 53 that that frictionally engage the ends of the bottom rail inner member 50 The substrate member 52 secures the bottom edge 22 of the shade material 18 to the bottom rail 16 by wedging it against the inner member 50. The bottom rail inner member 50 attaches the bottom rail lift cords 28 to the bottom rail 16.

The bottom rail 16 differs from the top rail 14 in that axially aligned cord routing apertures 54, 56 extend through only the inner and substrate members 50, 52. (The bottom rail cord routing apertures 54, 56 are located in axial alignment with the apertures 40, 42, 44, 32 in the top and head rails 14, 12.) Additionally, as shown in FIG. 4B, the ends of the bottom rail lift cords 28 are threaded down through the inner member cord routing apertures 54 and tied to washer-shaped securing elements 58. The diameter of the securing elements 58 is substantially greater than that of the cord routing apertures 54 to prevent them from passing therethrough.

Figure 5A:
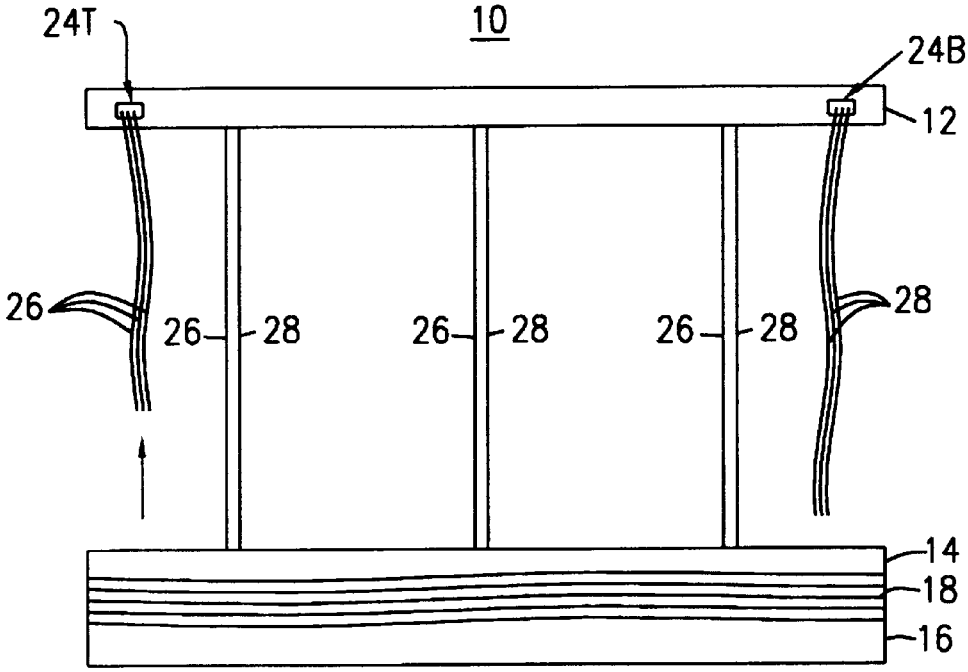
FIG. 5A is an elevational view of the shade of the invention opened down from the top.
Figure 5B:
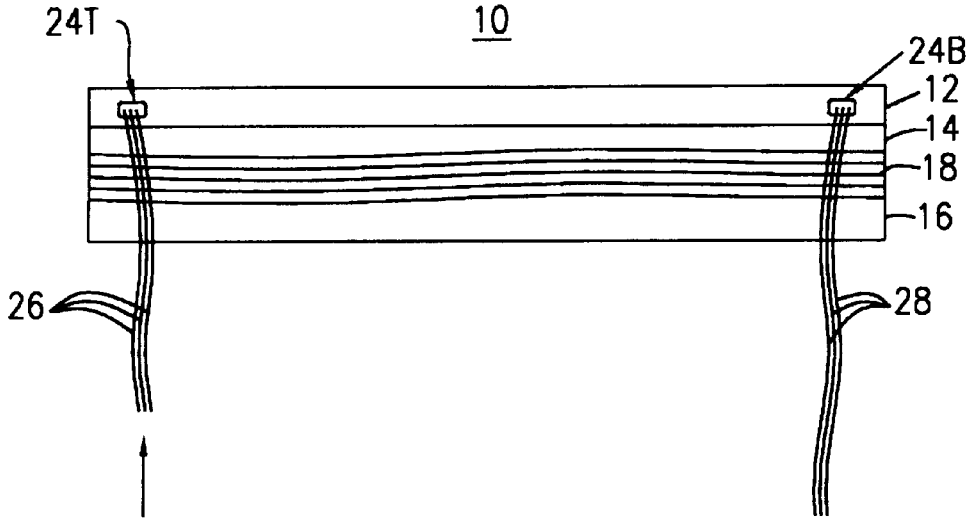
FIG. 5B is an elevational view of the shade of the invention opened up from the bottom.

Operating the lift cords 26 of the top rail lift mechanism 24T permits the shade 10 to be opened and closed from the top by lowering and raising the top rail 14 so that in the open position, the shade fabric 18 stacks against the bottom rail 16 as shown in FIG. 5A. Similarly, as shown in FIG. 5B, operating the lift cords 28 of the bottom rail lift mechanism 24B permits the shade 10 to be opened and closed from the bottom by raising and lowering the bottom rail 16 so that in the open position, the shade fabric 18 stacks against the top rail 14.

While the foregoing invention has been described with reference to the above embodiment, various modifications and changes can be made without departing from the spirit of the invention. Accordingly, all such modifications and changes are considered to be within the scope of the appended claims.

What is claimed is:

1. A window shade that opens from the top or the bottom thereof, the shade comprising:

a head rail;

a top rail;

a bottom rail; and an expanse of pleated shade material having a top edge attached to the top rail and a bottom edge attached to the bottom rail;

the head rail including a top rail lift mechanism for lowering and raising the top rail and a bottom rail lift mechanism for raising and lowering the bottom rail, the top rail lift mechanism including three top rail lift cords tied to the top rail and the bottom rail lift mechanism including three bottom rail lift cords secured to the bottom rail;

wherein the top rail includes an outer member, an inner member, and a substrate member, the inner and substrate members contained within the outer member, the inner member defining three pairs of laterally adjacent apertures disposed in the same plane for tying the top rail lift cords to the top rail.

2. The shade according to claim 1, wherein the bottom rail lift cords are secured to the bottom rail using washer-shaped elements.

3. The shade according to claim 1, wherein the substrate coacts with the inner member and outer member to secure the top edge of the shape material to the top rail.

4. The shade according to claim 1, wherein the bottom rail includes an outer member, an inner member, and a substrate member, the inner and substrate members being contained within the outer member.

5. The shade according to claim 4, wherein washer-shaped elements secure the bottom rail lift cords to the bottom rail, the elements sized not to pass through cord routing apertures defined in the inner member of the bottom rail.

6. The shade according to claim 4, wherein the substrate coacts with the inner member and outer member to secure the bottom edge of the shade material to the bottom rail.

7. The shade according to claim 1, wherein the top rail lift cords are captured with a first cord lock mechanism and the bottom rail lift cords are captured with a second cord lock mechanism.

8. A window shade that opens from the top or the bottom thereof, the shade comprising:

a head rail;

a top rail;

a bottom rail; and an expanse of shade material having a top edge attached to the top rail and a bottom edge attached to the bottom rail;

the head rail including a top rail lift mechanism for lowering and raising the top rail and a bottom rail lift mechanism for raising and lowering the bottom rail, the top rail lift mechanism including a top rail lift cord associated with the top rail and the bottom rail lift mechanism including a bottom rail lift cord associated with the bottom rail;

wherein each of the top and bottom rails include an outer member, an inner member, and a substrate member, the inner and substrate members contained within the outer member, the top rail inner member defining laterally adjacent apertures and the bottom rail inner member defining cord routing apertures.

9. The shade according to claim 8, wherein the bottom rail lift cords are secured to the bottom rail using washer-shaped elements, the elements sized not to pass through the cord routing apertures defined in the bottom rail inner member.

10. The shade according to claim 8, wherein the laterally adjacent apertures defined in the top rail inner member permit the top rail lift cords to be tied thereto.

11. The shade according to claim 8, wherein the laterally adjacent apertures are disposed in the same plane.

12. The shade according to claim 8, wherein the top rail lift cords are captured with a first cord lock mechanism and the bottom rail lift cords are captured with a second cord lock mechanism.

13. A window shade that opens from the top or the bottom thereof, the shade comprising:

a head rail;

a top rail;

a bottom rail; and an expanse of shade material having a top edge attached to the top rail and a bottom edge attached to the bottom rail;

the head rail including a top rail lift mechanism for lowering and raising the top rail and a bottom rail lift mechanism for raising and lowering the bottom rail, the top rail lift mechanism including three top rail lift cords tied to the top rail and the bottom rail lift mechanism including three bottom rail lift cords secured to the bottom rail;

wherein the bottom rail includes an outer member, an inner member, and a substrate member, the inner and substrate members being contained within the outer member and wherein washer-shaped elements secure the bottom rail lift cords to the bottom rail, the elements sized not to pass through cord routing apertures defined in the inner member of the bottom rail.

* * * * *